US008393415B2

(12) United States Patent
Bagassi

(10) Patent No.: US 8,393,415 B2
(45) Date of Patent: Mar. 12, 2013

(54) SUBSOIL AUTOMATIC ROTARY DRILLING SYSTEM FOR DRILLING OIL, MINERAL AND WATER WELLS

(76) Inventor: Walter Bagassi, Gropparello (IT)

( * ) Notice: Subject to any disclaimer, the term of this patent is extended or adjusted under 35 U.S.C. 154(b) by 227 days.

(21) Appl. No.: 12/322,212

(22) Filed: Jan. 30, 2009

(65) Prior Publication Data

US 2009/0200086 A1 Aug. 13, 2009

(30) Foreign Application Priority Data

Feb. 1, 2008 (IT) ..... PC2008A0095

(51) Int. Cl.
*E21B 19/00* (2006.01)

(52) U.S. Cl. ..... 175/85; 166/77.51

(58) Field of Classification Search ..... 175/85, 175/170

See application file for complete search history.

(56) References Cited

U.S. PATENT DOCUMENTS 3,291,225 A * 12/1966 Foran ..... 173/164
3,986,564 A * 10/1976 Bender ..... 173/4
4,503,917 A * 3/1985 Hargenrader et al. ..... 173/147
5,390,747 A * 2/1995 Gu et al. ..... 173/4
5,901,796 A * 5/1999 McDonald ..... 175/57
6,944,547 B2 * 9/2005 Womer et al. ..... 702/7
7,140,445 B2 * 11/2006 Shahin et al. ..... 166/380
2005/0061548 A1 * 3/2005 Hooper et al. ..... 175/52

FOREIGN PATENT DOCUMENTS

GB 2274827 A * 8/1994

* cited by examiner

*Primary Examiner* — William P Neuder
*Assistant Examiner* — Ronald Runyan
(74) *Attorney, Agent, or Firm* — Hedman & Costigan, P.C.

(57) ABSTRACT

A subsoil automatic rotary drilling system for drilling oil, mineral and water wells, characterized in that said system comprises, on a single system substructure, at least a triple-transmission hydraulic arrangement for lowering and raising a plurality of pipe elements to be introduced into and removed from a wellbore, said arrangement including a plurality of operating cables, each said cable having a dead end fixed to a cylinder carriage also supporting a plurality of transmission pulleys to handle together, while providing a triple stroke of pulling and pushing cylinders, two, three, four drilling pipe elements, having each a length of about 9.20 m (range 2).

1 Claim, 4 Drawing Sheets

SUBSOIL AUTOMATIC ROTARY DRILLING SYSTEM FOR DRILLING OIL, MINERAL AND WATER WELLS

BACKGROUND OF THE INVENTION

The present invention relates to a subsoil automatic rotary drilling system for drilling oil, mineral and water wells.

More specifically, the invention relates to such an automatic drilling system including a driving head and a lifting tackle, both driven by hydraulic cylinders having an operating cylinder stroke adapted to operatively drive three range-2 rods, with related container and loader means for the material necessary to properly perform the drilling operations.

As is known, onshore drilling operations and, in particular, the operations for installing and removing into/from the wellbore being made the series of pipes provided for forming the pipe string for forming the wellbore casing or lining, are conventionally performed, in a dedicated drilling yard including a respective drilling derrick, by dedicated systems which are generally of a mechanical arrangement.

The above mentioned prior pipe handling mechanical systems, however, have a lot of drawbacks negatively affecting the well productivity and operating safety.

Moreover, said prior mechanical systems include a very high number of operating and driving components, mainly of a mechanical nature, which are distributed through the overall drilling yard, even in a comparatively highly spaced condition.

SUMMARY OF THE INVENTION

Thus, the aim of the invention is to eliminate the above mentioned drawbacks, as well as yet other drawbacks, of prior mechanical well drilling systems including several drilling mechanical pieces and equipments arranged in a loose and separated condition through the overall drilling yard area.

Within the above mentioned aim, a main object of the present invention is to provide a fully automatic drilling system, for the above mentioned applications, in which, in particular, the handling of the pipe elements designed for forming the well casing or liner pipe string is performed in a fully automatic, substantially non mechanical, manner, thereby improving the productivity, profitability and safety of the producing well.

Another important object of the invention is to provide such an automatic drilling system reuniting, on a single drilling system substructure, either of a fixed or skidding type, a complete arrangement of mechanical, hydraulic, electric and electronic equipments, and also including a novel drilling derrick supporting a driving head which is vertically bidirectionally driven by a plurality of driving hydraulic cylinders operating preferably in a pulling mode of operating, thereby overcoming any combined bending and compressive stress problems.

Another important object of the invention is to provide such an automatic drilling system including lifting cables and a cable triple transmission arrangement thereby allowing to use pulling and pushing hydraulic cylinders of small length to provide a driving head lifting and lowering displacement substantially corresponding to three times the cylinder stroke.

Yet another object of the invention is to provide such a drilling system including a safety load braking system for braking the drilling load if a load supporting cable would be broken.

The above mentioned aim and objects, as well as yet other objects, which will become more apparent hereinafter, are achieved by an automatic drilling system according to the enclosed claims.

BRIEF DESCRIPTION OF THE DRAWING

Further characteristics and advantages of the automatic well drilling system according to the present invention will become more apparent hereinafter from the following detailed disclosure of a preferred, though not exclusive, embodiment thereof, which is illustrated, by way of an indicative, but not limitative, example, in the accompanying drawing, where.

DESCRIPTION OF THE PREFERRED EMBODIMENT

Figure 1:
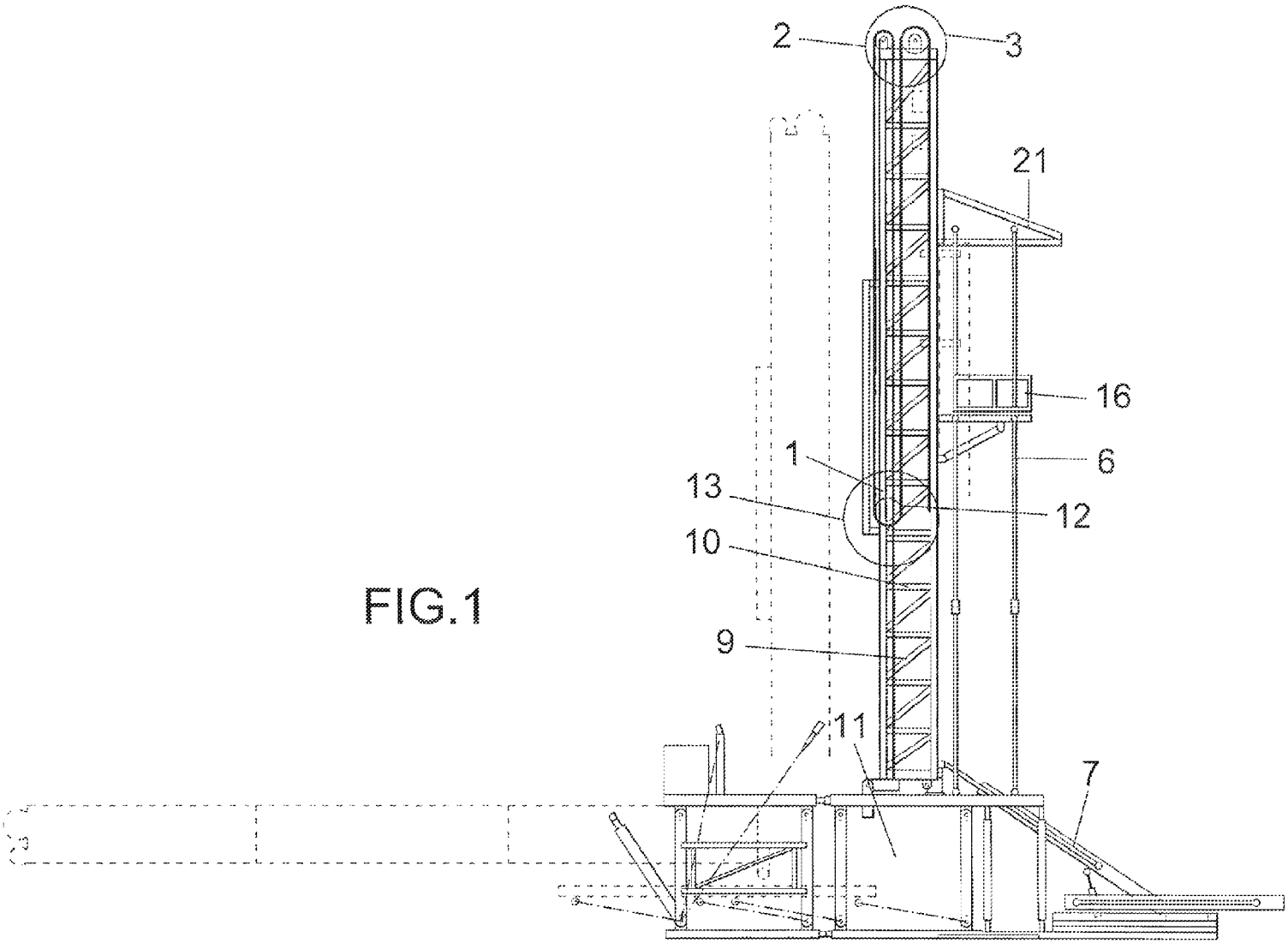
FIG. 1 is a schematic view showing the overall layout of a drilling yard according to the present invention.
Figure 2:
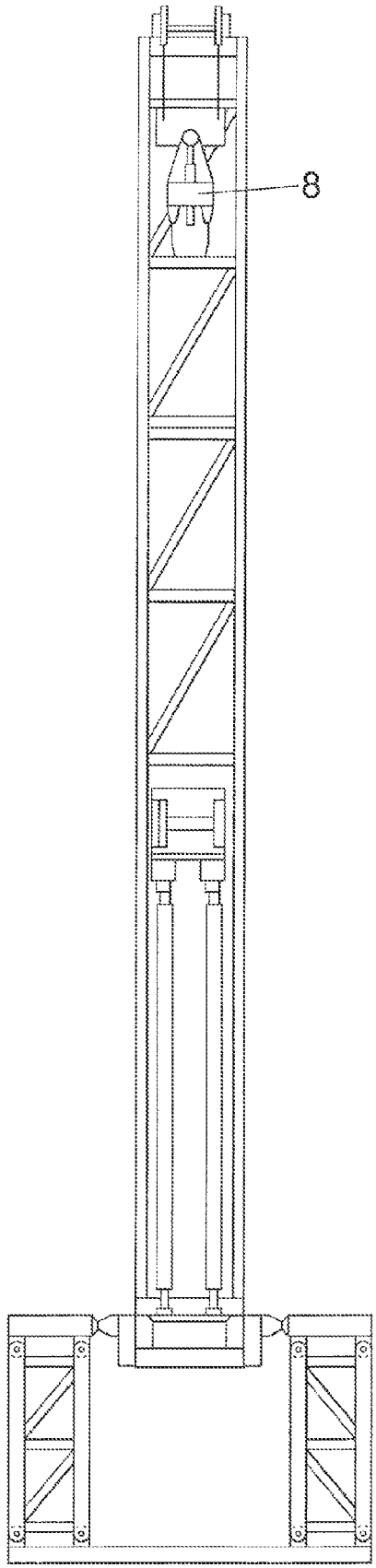
FIG. 2 is a partial side view of FIG. 1.
Figure 3:
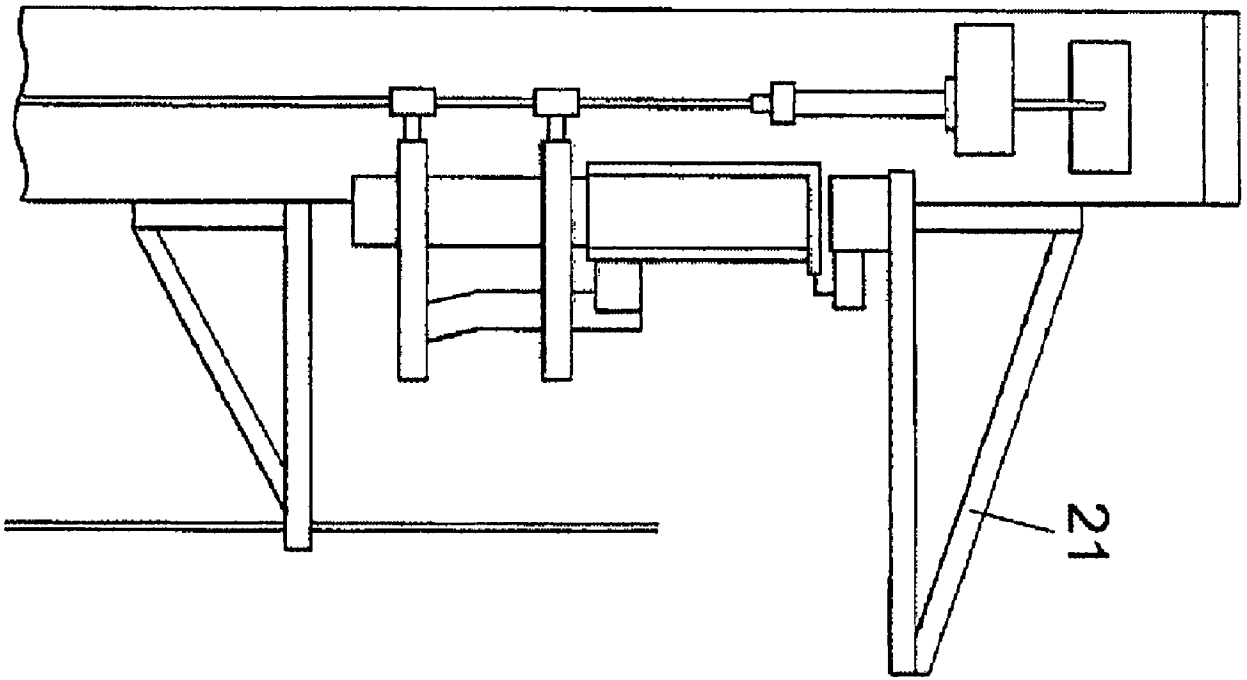
FIG. 3 is a detail view of pipe loader means.
Figure 4:
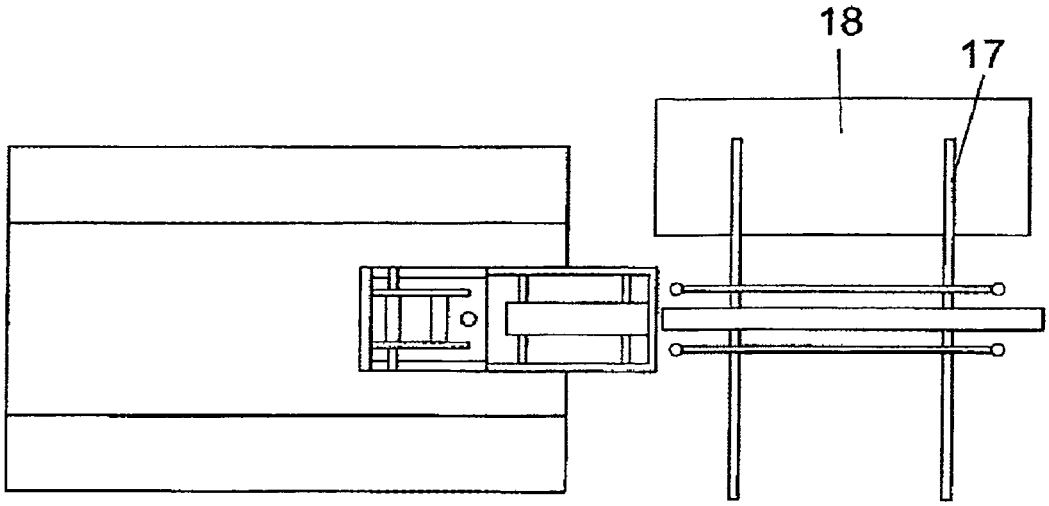
FIG. 4 is a detail view of pipe bearing frames and pipe containers.

With reference to the drawing, the inventive well drilling system or yard comprises, on a single substructure, the following main component elements: substructure means 11, including two parallelogram frames adapted to support the overall weight of the drilling system; a derrick fixed construction 10 with a fixed tackle 3 and a rotary driving head 8, a loader 7 for loading pipe elements 6 as necessary for providing the drilling pipe string for encasing or lining the wellbore being drilled.

The system further comprises a plurality of cables each having a dead end 1, as well as pulling and pushing cylinders 9, a first transmission pulley 2, a second transmission pulley 12 and a third transmission pulley 3.

More specifically, the inventive drilling system, which is exclusively applied to an automatic well rotary drilling system or yard, comprises a lot of operating components all of which are assembled on a single fixed or movable substructure. Thus, on this substructure are assembled all the drilling system or yard components and, in particular, a driving system including a plurality of hydraulic jack means, for rotatively and vertically driving the above rotary head 8, the hydraulic jacks also providing a bidirectional vertical displacement, either a raising displacement or lowering displacement of said head, thereby it is possible to perform tackle, or screw on, or screw off operations, by the driving head, of one or two or three rods threaded to one another, each having a length of about 9.20 m (range 2), of a high weight, as well as casing pipe elements having a length of about 13/14 meters either in a double or triple arrangement.

According to the invention, the drilling system or yard further comprises a specifically designed loader means including clamping hydraulic grippers to drive the double or triple pipe or tubular material 6 from/into the containers 18 on the axis of the driving head; an automatic handling bridge arrangement 16, driven by hydraulic cylinders and/or flameproof electric motors, transferring the pipe elements withdrawn from the well to/into the handling bridge, with the mentioned hydraulic grippers; further loader means 21, bearing drilling bits, connection fittings and stabilizer element adjoining the drilling derrick, as driven by hydraulic cylinders, adapted to bring said drilling bits and variable diameter fitting connections and stabilizers to the center of the wellbore being drilled to cause them to be engaged and/or taken by the driving head.

The inventive drilling system also comprises a load braking system (not shown) adapted to brake the pipe load if, during the drilling operations, one of the load supporting cables would be broken.

Thus, by resuming, the invention provides to use, in a well drilling system or yard, and supported on a single substructure, a triple-transmission hydraulic system, for raising pipe elements to be removed from and engaged in the wellbore, with a plurality of cables each of which has a dead cable end 1, each cable dead end 1 being connected to a cylinder carriage 13 thereon are mounted a plurality of transmission pulleys 12 to handle, with a triple pulling and pushing cylinder stroke, two, three, four drilling pipe elements 6, together, and each having a length of about 9.20 meters (range 2). Thus, the above system allows to include a plurality of pulling and pushing cylinders having a comparatively small shipment dimension, said cylinders being mounted within a small size construction where, through the above disclosed transmission means, it is possible to simultaneously handle about 30 meters of pipe elements both into and off the wellbore.

According to a further aspect, the inventive system includes a plurality of cylinders 9, the number of which can be simply and quickly changed to increase the system pulling capability. Thus, the system allows, by merely increasing the number of the cylinders, to make a logging drilling system having a drilling capability from about 100 ton to about 1500-2000 ton.

According to a further aspect of the invention, the inventive drilling system further comprises a loader means 21 for the tubular pipe elements 6, including a plurality of clamping grippers (not shown) or the like. Said loader means, in particular, takes or supplies the tubular or pipe elements 6 from the driving head 8 while locking them by its grippers, and upon having gripped the pipes 6, said loader performing a rotary movement through 45.degree., to move toward and/or away from the drilling derrick the pipe elements gripped thereby to introduce or remove them into/from a handling bridge 16, during the handling and drilling operations. Thus, at the start and end of the wellbore drilling, the pipe elements 6 are supplied or taken to/from the system through the loader, operating as a lay up and down machine 7, which takes and supplies the pipe elements 6 to the pipe element bearing frames 17 and to the pipe element containers 18.

According to a further aspect of the invention, the invention provides an automatic drilling system which can be controlled by a single operator, for withdrawing and relocating the pipe elements 6 from/into the wellbore and performing the drilling operations by adding as necessary drilling pipe elements 6, the assembly being managed by a PLC from a control panel in the control cab.

According to a further aspect of the invention, the inventive drilling system further comprises further loader means bearing drilling bits and connection fittings, as well as stabilizer elements, said loader means being arranged adjoining the drilling derrick, and being driven by a hydraulic cylinder to transfer the drilling bits and variable diameter connection fittings as well as stabilizer elements to the center of the wellbore, to cause them to be taken by the driving head 8.

According to yet another aspect of the invention, the inventive drilling system further comprises a braking system for braking the driving head if, during the drilling operations, one of the load supporting cables would be broken.

While the invention has been disclosed with reference to a preferred embodiment thereof, it should be apparent that the disclosed embodiment is susceptible to several modifications and variations, all of which will come within the scope of the invention.

The invention claimed is:

1. A programmable logic controlled (PLC) subsoil automatic rotary drilling system for drilling oil, mineral and water wells and forming a pipe casing in a drilled well, wherein said system comprises, on a single supporting fixed or skidding substructure, a vertically extending drilling derrick associated with a plurality of pulling and pushing hydraulic cylinders acting in parallel to raise and lower an attachment, said attachment being connected to a fixed reference with cables and pulleys to provide a lifting cable end with a mechanical advantage greater than 2, for lowering and raising a plurality of well casing forming pipe elements to be introduced into and removed from a wellbore being drilled by said drilling derrick, each said cable having a dead end fixed to a cylinder carriage also supporting a plurality of transmission pulleys to handle together, while providing a standard hydraulic double acting cylinder system, two or three drilling pipe elements threaded together, having each a length of about 9.20 m, thereby said well casing forming pipe elements on said single supporting substructure are handled in a fully automatic manner to form said well casing, said drilling derrick reciprocally supporting a bidirectionally vertically movable rotary driving head, said driving head being supplied with and handling drilling bits, casing pipe elements, fittings and stabilizer elements and being driven by pulling hydraulic cylinders to overcome combined bending and compressive stress forces, wherein said drilling system further comprises, on said single supporting substructure, automatic swinging pipe element loader means for automatically gripping and loading said well casing forming pipe elements, wherein said pulling and pushing hydraulic cylinders vertically lift and lower said driving head by a vertical stroke corresponding to three times a stroke of said hydraulic cylinders, and wherein said driving head is a brakable driving head being braked as an operating load on said driving head exceeds a threshold operating load.

* * * * *

UNITED STATES PATENT AND TRADEMARK OFFICE

CERTIFICATE OF CORRECTION

PATENT NO. : 8,393,415 B2
APPLICATION NO. : 12/322212
DATED : March 12, 2013
INVENTOR(S) : Walter Bagassi It is certified that error appears in the above-identified patent and that said Letters Patent is hereby corrected as shown below:

Title Page, item (30) Foreign Application Priority Data should read as follows:

Feb. 1, 2008 (IT)..... PC2008A 000005

Signed and Sealed this
Fourth Day of November, 2014

Michelle K. Lee

Michelle K. Lee
*Deputy Director of the United States Patent and Trademark Office*